US007608373B2

(12) United States Patent
Kotsugai et al.

(10) Patent No.: US 7,608,373 B2
(45) Date of Patent: Oct. 27, 2009

(54) TONER FOR DEVELOPING ELECTROSTATIC LATENT IMAGE, DEVELOPER USING THE TONER, AND PROCESS CARTRIDGE, IMAGE FORMING APPARATUS AND IMAGE FORMING METHOD USING THE DEVELOPER

(75) Inventors: Akihiro Kotsugai, Numazu (JP); Satoshi Mochizuki, Numazu (JP); Sonoh Matsuoka, Numazu (JP); Takuya Saito, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 409 days.

(21) Appl. No.: 11/338,700

(22) Filed: Jan. 25, 2006

(65) Prior Publication Data

US 2006/0172215 A1 Aug. 3, 2006

(30) Foreign Application Priority Data

Jan. 25, 2005 (JP) ..... 2005-016366
Mar. 15, 2005 (JP) ..... 2005-073359

(51) Int. Cl.
*G03G 9/09* (2006.01)

(52) U.S. Cl. ..... 430/108.23; 430/109.4

(58) Field of Classification Search ..... 430/45.55, 430/108.23, 109.4
See application file for complete search history.

(56) References Cited

U.S. PATENT DOCUMENTS

| | | | | |
|---|---|---|---|---|
| 7,258,959 | B2 | 8/2007 | Nakayama et al. | |
| 2001/0023048 | A1* | 9/2001 | Shoji et al. | 430/110.3 |
| 2002/0015905 | A1* | 2/2002 | Isonaka et al. | 430/111.35 |
| 2003/0064309 | A1* | 4/2003 | Komoto et al. | 430/106.1 |
| 2003/0162116 | A1* | 8/2003 | Katsuta et al. | 430/108.23 |
| 2003/0224273 | A1* | 12/2003 | Koido et al. | 430/108.1 |
| 2003/0232266 | A1* | 12/2003 | Sugiura et al. | 430/107.1 |
| 2004/0264826 | A1* | 12/2004 | Hori et al. | 384/614 |
| 2004/0265726 | A1* | 12/2004 | Yamazaki et al. | 430/126 |
| 2005/0026064 | A1 | 2/2005 | Sugiura et al. | |
| 2005/0089786 | A1 | 4/2005 | Sugiura et al. | |
| 2005/0089787 | A1 | 4/2005 | Uchinokura et al. | |
| 2005/0208408 | A1 | 9/2005 | Uchinokura et al. | |

FOREIGN PATENT DOCUMENTS

| | | |
|---|---|---|
| JP | 2-37949 | 8/1990 |
| JP | 6-230607 | 8/1994 |
| JP | 6-266163 | 9/1994 |
| JP | 07-230184 | 8/1995 |
| JP | 8-262799 | 10/1996 |
| JP | 11-202558 | 7/1999 |
| JP | 11-242357 | 9/1999 |
| JP | 2001-109196 | 4/2001 |
| JP | 2001-166540 | 6/2001 |
| JP | 2004-212451 | 7/2004 |

OTHER PUBLICATIONS

U.S. Appl. No. 11/558,736, filed Nov. 10, 2006, Osamu Uchinokura, et al.
U.S. Appl. No. 11/934,929, filed Nov. 21, 2007, Nakayama, et al.
U.S. Appl. No. 11/943,972, filed Nov. 21, 2007, Nakayama, et al.
U.S. Appl. No. 12/049,686, filed Mar. 17, 2008, Kotsugai, et al.
U.S. Appl. No. 12/050,502, filed Mar. 18, 2008, Yamada, et al.

* cited by examiner

*Primary Examiner*—Mark F Huff
*Assistant Examiner*—Rachel L Burney
(74) *Attorney, Agent, or Firm*—Oblon, Spivak, McClelland, Maier & Neustadt, L.L.P.

(57) ABSTRACT

A toner is provided containing a parent particulate material, which contains;

a first colorant, a second colorant, and a binder resin, wherein the first colorant contains an organic pigment having a primary particle diameter distribution with a median diameter of from 0.08 to 0.12 μm, and the second colorant contains an organic pigment having a primary particle diameter distribution with a median diameter of from 0.01 to 0.06 μm, and each of the first colorant and second colorant have the following formula (1)

(1)

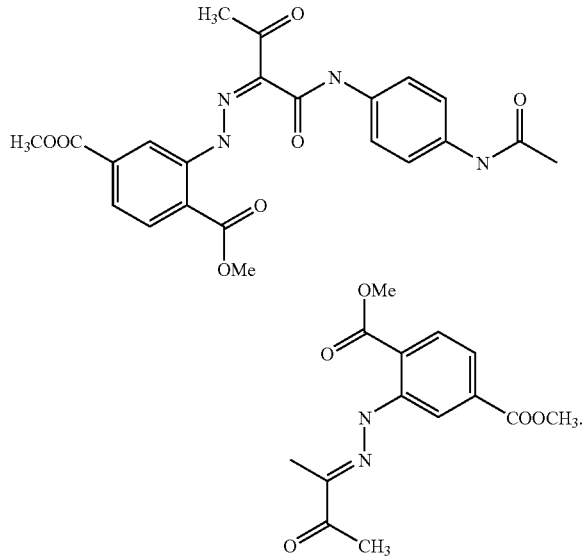

20 Claims, No Drawings

TONER FOR DEVELOPING ELECTROSTATIC LATENT IMAGE, DEVELOPER USING THE TONER, AND PROCESS CARTRIDGE, IMAGE FORMING APPARATUS AND IMAGE FORMING METHOD USING THE DEVELOPER

BACKGROUND OF THE INVENTION

1. Field of the Invention

The present invention relates to a toner for developing electrostatic latent images, for use in electrophotographic apparatus and electrostatic recording apparatus, and to a developer using the toner, and a process cartridge, an image forming method and an image forming apparatus using the developer.

2. Discussion of the Background

In the electrophotographic apparatus and electrostatic recording apparatus, a toner is adhered to an electrostatic latent image formed on a photoreceptor to form a toner image thereon, and the toner image is transferred onto a transfer material and is fixed thereon with heat. Full-color images are typically reproduced by overlapping a black toner image, a yellow toner image, a magenta toner image and a cyan toner image on a transfer material and simultaneously fixing them with heat thereon.

However, users who are used to seeing printings are not typically satisfied with the image quality produced by a full-color copier yet, and a higher definition and a resolution close to the photographs and printings thereof are required. It is known that a toner having a small particle diameter and a narrow distribution thereof is used to produce high-quality images in electrophotography.

A conventional pulverized toner is prepared by kneading a colorant, a charge controlling agent, an offset inhibitor, etc. in a thermoplastic resin upon application of heat, uniformly dispersing them therein to prepare a mixed composition, and pulverizing and classifying the mixed composition. The pulverized toner tends to have a wide particle diameter distribution, and for example, fine particles having a diameter not greater than 5 μm and coarse particles having a diameter not less than 20 μm have to be removed to produce images having good image resolution and tone reproduction, and therefore a yield extremely decreases. In addition, it is difficult to uniformly disperse the colorant, charge controlling agent and the like in the thermoplastic resin by the pulverization method. Nonuniform dispersion thereof adversely affects fluidity, developability and durability of the resultant toner and image quality produced thereby.

Recently, polymerization methods of preparing a toner have been suggested to get rid of the problems of the pulverization method. The polymerization methods of preparing a toner for developing electrostatic latent images, such as a suspension polymerization method, are known.

The polymerization methods can save the conventional pulverizing and kneading processes to save energy, and can shorten preparation time and improve process yield to reduce cost. Further, the polymerization methods can make the particle diameter of a toner smaller and the particle diameter distribution thereof shaper than a pulverized toner to produce higher-quality images.

In order to produce electrophotographic full-color images having quality similar to that of printings, each color toner needs to have high color reproducibility. In order to achieve this without problems, a colorant having good transparency, light resistance and heat resistance is highly dispersed in a toner.

Conventional colorants for a yellow toner have various problems, e.g., dye colorants typically have poor light resistance and image preservation stability although having good transparency.

Although pigments have light resistance higher than that of dyes, they preferably have light resistance as high as copper phthalocyanine pigments.

Further, yellow pigments having good light and heat resistance has opacifying strength too strong to extremely deteriorate transparency thereof, and which is unsuitable for producing full-color images.

Japanese Patent Publication NO. 2-37949 discloses a disazo compound having good light resistance and a method of preparing the disazo compound. This is a compound group typified by PIGMENT YELLOW 180 which is one of azo pigments in compliance with the recent safety requirement.

Japanese Laid-Open Patent Publications Nos. 6-230607, 6-266163 and 8-262799 disclose toners using the PIGMENT YELLOW 180, which do not have good colorability nor good transparency, but the pigment is often used for pulverized toners.

In a chemical toner, a state of existence of a pigment occasionally varies due to its original properties. According to the dispersibility and dispersed stability of the pigment therein, the pigment agglutinates therein or separates out onto the surface thereof when granulated, resulting in variation of fixability and chargeability thereof. The PIGMENT YELLOW 180 having high hydrophilicity is difficult to use in methods of dispersing an oil phase in water such as a suspension polymerization method because of segregating on the surface of a toner or re-agglutinating therein.

Japanese Laid-Open Patent Publications Nos. 2004-212451, 2001-166540, 2001-109196, 11-202558 and 7-230184 disclose PIGMENT YELLOW 155 having a good spectroscopic property, which are sued in various polymerization methods and pulverization methods. Since the PIGMENT YELLOW 155 is not so hydrophilic as the PIGMENT YELLOW 180 and need not be surface-treated, the PIGMENT YELLOW 155 can more easily be used. However, the PIGMENT YELLOW 155 has high agglutinability and poor dispersed stability.

Because of these reasons, a need exists for a toner producing images having sufficient image density as well as having good developability, transferability and fixability without excessive uneven dispersion of a pigment on the surface thereof.

SUMMARY OF THE INVENTION

Accordingly, one object of the present invention is to provide a toner:

producing images having sufficient image density as well as having good developability, transferability and fixability without excessive uneven dispersion of a pigment on the surface thereof;

having high chargeability, good readiness for being charged, less toner spent on a carrier, capability of maintaining the high chargeability and fluidity, and producing images having less background fouling and sufficient image density; and having good environment resistance and producing images having no variation of color reproducibility.

Another object of the present invention is to provide a developer using the toner.

A further object of the present invention is to provide a process cartridge using the toner.

Another object of the present invention is to provide an image forming apparatus using the toner.

These objects and other objects of the present invention, either individually or collectively, have been satisfied by the discovery of a toner comprising:

a parent particulate material, comprising;

a first colorant, a second colorant, and a binder resin, wherein the first colorant comprises an organic pigment having a primary particle diameter distribution with a median diameter of from 0.08 to 0.12 μm, and the second colorant comprises an organic pigment having a primary particle diameter distribution with a median diameter of from 0.01 to 0.06 μm, and each of said first colorant and second colorant having the following formula (1).

(1)

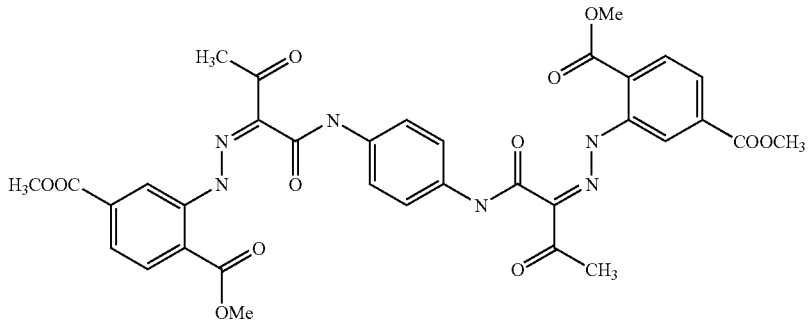

A mixing ratio of the first colorant to the second colorant is preferably from 1/9 to 1/1 by weight.

The toner is preferably formed from a masterbatch comprising the binder resin and the colorant.

These and other objects, features and advantages of the present invention will become apparent upon consideration of the following description of the preferred embodiments of the present invention taken in conjunction with the accompanying drawings.

DETAILED DESCRIPTION OF THE INVENTION

The present invention provides a toner having good transparency, fixability and chargeability.

The present invention relates to a toner, comprising:

a parent particulate material, comprising;

a first colorant, a second colorant, and a binder resin, wherein the first colorant comprises an organic pigment having a primary particle diameter distribution with a median diameter of from 0.08 to 0.12 μm, and the second colorant comprises an organic pigment having a primary particle diameter distribution with a median diameter of from 0.01 to 0.06 μm, and each of said first colorant and second colorant having the following formula (1)

(1)

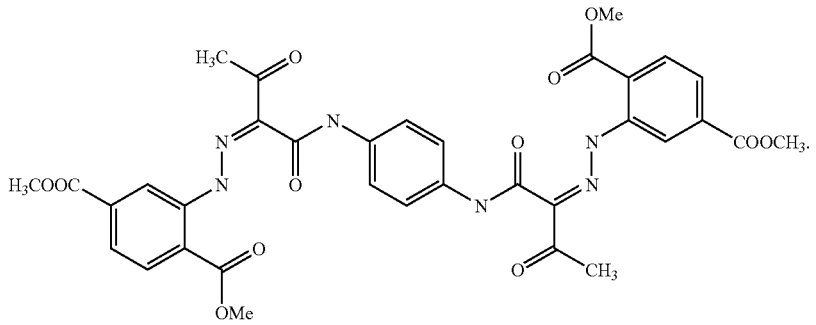

The above-mentioned pigment is microscopically dispersed in a toner, and azo pigments having high hydrophilicity tend to separate from a resin having low hydrophilicity. Particularly, since the above-mentioned pigment has high associatability and agglutinability, when the pigment is present in a liquid when a resin is melted, dissolved or dispersed in a monomer in the process of preparing a toner, the pigment re-agglutinates and the transparency of the resultant toner occasionally deteriorates. Particularly, since the viscosity of a resin solution largely increases in the process of preparing a toner, such as various polymerization methods and dissolution suspension methods, the particle diameter thereof is difficult to control when granulated, the pigment noticeably separates out on the surface thereof, and the resultant toner tends to have a high viscosity when melted.

The present inventors discovered that the pigment having said structure and a primary particle diameter in a specific scope prevents them from agglutinating in a liquid and being unevenly distributed on the surface of a chemical toner when prepared, and forms a good toner without deterioration of transparency or increase of viscosity when melted.

The pigment preferably has a median diameter of from 0.08 to 0.12 μm in a primary particle diameter distribution thereof. When less than 0.08 μm, increase of the viscosity of the resin solution, uneven distribution of the pigment and inhibition of fixability of the resultant toner tend to occur although having good transparency. When greater than 0.12 μm, the resultant toner has poor transparency.

Therefore, in addition to the pigment having a median diameter of from 0.08 to 0.12 μm in a primary particle diameter distribution thereof, the pigment having a median diameter of from 0.01 to 0.06 μm in a primary particle diameter distribution thereof is used together to improve the fixability of the resultant toner without impairing the transparency thereof.

The toner of the present invention preferably includes a polyester resin as a binder resin because the polyester resin stabilizes the dispersibility of the pigment unless the polarity thereof is extremely increased. In addition, the polyester resin is preferably used because the viscoelasticity thereof can properly be controlled.

The colorant for use in the present invention is a pigment having the following formula (1) and a median diameter of from 0.08 to 0.12 μm in a primary particle diameter distribution thereof.

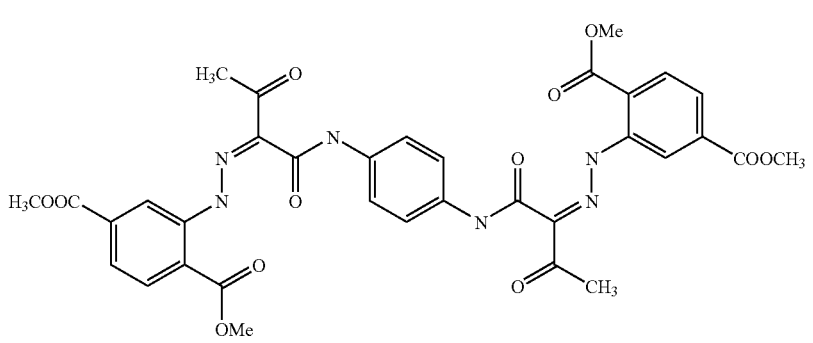

(1)

The median diameter in a primary particle diameter distribution of the pigment of the present invention is measured as follows:

sampling the pigment on a collodion film;

imaging a particulate image of the pigment by a TEM observation at a 35,000-fold magnification;

measuring each particle diameter (a feret diameter) of 500 to 1,000 pigments; and calculating an accumulated distribution of the particle diameter to determine a median diameter thereof.

The toner preferably includes the colorant in an amount of from 1 to 15% by weight and more preferably from 3 to 10% by weight.

The colorant for use in the present invention can be used as a masterbatch pigment when combined with a resin. Specific examples of the resin for use in the masterbatch pigment or for use in combination with master batch pigment include the modified and unmodified polyester resins mentioned above; styrene polymers and substituted styrene polymers such as polystyrene, poly-p-chlorostyrene and polyvinyltoluene; styrene copolymers such as a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl α-chloromethacrylate copolymer, a styrene-acrylonitrile copolymer, a styrene-vinyl methyl ketone copolymer, a styrene-butadiene copolymer, a styrene-isoprene copolymer, a styrene-acrylonitrile-indene copolymer, a styrene-maleic acid copolymer and a styrene-maleic acid ester copolymer; and other resins such as polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The masterbatch for use in the toner of the present invention is typically prepared by mixing and kneading a resin and a colorant upon application of high shear stress thereto. In this case, an organic solvent can be used to heighten the interaction of the colorant with the resin. In addition, flushing methods in which an aqueous paste including a colorant is mixed with a resin solution of an organic solvent to transfer the colorant to the resin solution and then the aqueous liquid and organic solvent are separated and removed can be preferably used because the resultant wet cake of the colorant can be used as it is. Of course, a dry powder which is prepared by drying the wet cake can also be used as a colorant. In this case, a three roll mill is preferably used for kneading the mixture upon application of high shearing stress.

In the present invention, the following modified polyester can be used. For example, a polyester prepolymer having an isocyanate group can be used. The polyester prepolymer (A) is formed from a reaction between polyester having an active hydrogen atom formed by polycondensation between polyol (1) and a polycarboxylic acid (2), and polyisocyanate (3). Specific examples of the groups including the active hydrogen include a hydroxyl group (an alcoholic hydroxyl group and a phenolic hydroxyl group), an amino group, a carboxyl group, a mercapto group, etc. In particular, the alcoholic hydroxyl group is preferably used.

As the polyol (1), diol (1-1) and polyol having 3 valences or more (1-2) can be used, and (1-1) alone or a mixture of (1-1) and a small amount of (1-2) are preferably used. Specific examples of diol (1-1) include alkylene glycol such as ethylene glycol, 1,2-propylene glycol, 1,3-propylene glycol, 1,4-butanediol, and 1,6-hexanediol; alkylene ether glycol such as diethylene glycol, triethylene glycol, dipropylene glycol, polyethylene glycol, polypropylene glycol and polytetramethylene ether glycol; alicyclic diol such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide.

In particular, alkylene glycol having 2 to 12 carbon atoms and adducts of bisphenol with an alkylene oxide are preferably used, and a mixture thereof is more preferably used. Specific examples of the and polyol having 3 valences or more (1-2) include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide.

As the polycarboxylic acid (2), dicarboxylic acid (2-1) and polycarboxylic acid having 3 or more valences (2-2) can be used. (2-1) alone, or a mixture of (2-1) and a small amount of (2-2) are preferably used. Specific examples of the dicarboxylic acid (2-1) include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used. Specific examples of the polycarboxylic acid having 3 or more valences (2-2) include aromatic polycarboxylic acids having 9 to 20 carbon atoms such as trimellitic acid and pyromellitic acid. The polycarboxylic acid (2) can be formed from a reaction between the polyol (1) and the above-mentioned acids anhydride or lower alkyl ester such as methyl ester, ethyl ester and isopropyl ester.

The polyol (1) and polycarboxylic acid (2) are mixed such that an equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

Specific examples of the polyisocyanate (3) include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; aromatic diisocyanate such as tolylenedisocyanate and diphenylmethanediisocyanate; aroma aliphatic diisocyanate such as $\alpha,\alpha,\alpha',\alpha'$-tetramethylxylylenediisocyanate; isocyanurate; the above-mentioned polyisocyanate blocked with phenol derivatives, oxime and caprolactam; and their combinations.

The polyisocyanate (3) is mixed with polyester such that an equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1. When [NCO]/[OH] is greater than 5, low-temperature fixability of the resultant toner deteriorates. When [NCO] has a molar ratio less than 1, a urea content in ester of the modified polyester decreases and hot offset resistance of the resultant toner deteriorates. The content of the constitutional component of a polyisocyanate in the polyester prepolymer (A) having a polyisocyanate group at its end is from 0.5 to 40% by weight, preferably from 1 to 30% by weight and more preferably from 2 to 20% by weight. When the content is less than 0.5% by weight, hot offset resistance of the resultant toner deteriorates, and in addition, the heat resistance and low-temperature fixability of the toner also deteriorate. In contrast, when the content is greater than 40% by weight, low-temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the modified polyester after crosslinked and/or elongated decreases and hot offset resistance of the resultant toner deteriorates.

In the present invention, as a crosslinking and/or elongating agent, amines can be used. Specific examples of the amines (B) include diamines (B1), polyamines (B2) having three or more amino groups, amino alcohols (B3), amino mercaptans (B4), amino acids (B5) and blocked amines (B6) in which the amino groups in the amines (B1) to (B5) are blocked.

Specific examples of the diamines (B1) include aromatic diamines such as phenylene diamine, diethyltoluene diamine and 4,4'-diaminodiphenyl methane; alicyclic diamines such as 4,4'-diamino-3,3'-dimethyldicyclohexyl methane, diaminocyclohexane and isophorondiamine; aliphatic diamines such as ethylene diamine, tetramethylene diamine and hexamethylene diamine, etc.

Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan.

Specific examples of the amino acids (B5) include amino propionic acid and amino caproic acid. Specific examples of the blocked amines (B6) include ketimine compounds which are prepared by reacting one of the amines (B1) to (B5) with a ketone such as acetone, methyl ethyl ketone and methyl isobutyl ketone; oxazoline compounds, etc. Among these amines (B), diamines (B1) and mixtures in which a diamine is mixed with a small amount of a polyamine (B2) are preferably used.

A molecular weight of the modified polyesters after reacted can optionally be controlled using a crosslink and/or elongation anticatalyst, if desired. Specific examples of the elongation anticatalyst include monoamines such as diethyle amine, dibutyl amine, butyl amine and lauryl amine, and blocked amines, i.e., ketimine compounds prepared by blocking the monoamines mentioned above.

A mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than 1/2, molecular weight of the modified polyester decreases, resulting in deterioration of hot offset resistance of the resultant toner.

In the present invention, an unmodified polyester resin (C) can be used in combination with the modified polyester resin (A) as a toner binder resin. It is more preferable to use the unmodified polyester resin (C) in combination with the modified polyester resin than to use the modified polyester resin alone because a low-temperature fixability and a glossiness of full color images of the resultant toner improve. Specific examples of the unmodified polyester resin (C) include polycondensated products between the polyol (1) and polycarboxylic acid (2) similarly to the modified polyester resin (A), and products preferably used are the same as those thereof. The unmodified polyester (C) can be substituted with another modified polyester other than a urea-modified polyester such as a urethane-modified polyester.

It is preferable that the modified polyester resin (A) and unmodified polyester resin (C) are partially soluble each other in terms of the low-temperature fixability and hot offset resistance of the resultant toner. Therefore, the modified polyester resin (A) and unmodified polyester resin (C) preferably have similar compositions. When the unmodified polyester resin (C) is used in combination, a weight ratio ((A)/(C)) between the modified polyester resin (A) and unmodified polyester resin (C) is from 5/95 to 75/25, preferably from 10/90 to 25/75, more preferably from 12/88 to 25/75, and most preferably from 12/88 to 22/78. When the modified polyester resin (A) has a weight ratio less than 5%, the resultant toner has a poor hot offset resistance, and has a difficulty in having a thermostable preservability and a low-temperature fixability.

The unmodified polyester resin (C) preferably has a peak molecular weight of from 1,000 to 30,000, preferably from 1,500 to 10,000, and more preferably from 2,000 to 8,000. When less than 1,000, the thermostable preservability of the resultant toner deteriorates. When greater than 10,000, the low-temperature fixability thereof deteriorates. The unmodified polyester resin (C) preferably has a hydroxyl value not less than 5 mg KOH/g, more preferably of from 10 to 120 mg KOH/g, and most preferably from 20 to 80 mg KOH/g. When less than 5, the resultant toner has a difficulty in having a thermostable preservability and a low-temperature fixability.

The unmodified polyester resin (C) preferably has an acid value of from 0.5 to 40 mg KOH/g, and more preferably from 5 to 35 mg KOH/g such that the resultant toner tends to be negatively charged and to have better fixability. When the acid value and hydroxyl value are greater than the maximum value, the resultant toner tends to be affected by an environment such as an environment of high (low) temperature and high (low) humidity, and produces poor quality images.

The toner of the present invention preferably has a glass transition temperature (Tg) of from 40 to 70° C., and more preferably from 45 to 55° C. When less than 40° C., a thermostable preservability of the resultant toner deteriorates. When greater than 70° C., a low-temperature fixability thereof is insufficient. The toner of the present invention including the crosslinked and/or elongated polyester resin has a better thermostable preservability than known polyester toners even though the glass transition temperature is low.

The toner preferably has a temperature (TG') not less than 100° C., and more preferably of from 110 to 200° C. at which a storage modulus of the toner binder resin is 10,000 dyne/$cm^2$ at a measuring frequency of 20 Hz. When less than 100° C., the hot offset resistance of the resultant toner deteriorates.

The toner preferably has a temperature (Tη) not greater than 180° C., and more preferably of from 90 to 160° C. at which a viscosity is 1,000 poise at a measuring frequency of 20 Hz. When greater than 180° C., the low-temperature fixability of the resultant toner deteriorates. Namely, TG' is preferably higher than Tη in terms of the low-temperature fixability and hot offset resistance of the resultant toner. In other words, a difference between TG' and Tη (TG'-Tη) is preferably not less than 0° C., more preferably not less than 10° C., and furthermore preferably not less than 20° C. A maximum of the difference is not particularly limited. In terms of the thermostable preservability and low-temperature fixability of the resultant toner, the difference between TG' and Tη (TG'-Tη) is preferably from 0 to 20° C., more preferably from 10 to 90° C., and most preferably from 20 to 80° C.

The toner of the present invention may include a wax together with a binder resin and a colorant. Specific examples of the wax include known waxes, e.g., polyolefin waxes such as polyethylene wax and polypropylene wax; long chain carbon hydrides such as paraffin wax and sasol wax; and waxes including carbonyl groups.

Among these waxes, the waxes including carbonyl groups are preferably used. Specific examples thereof include polyesteralkanate such as carnauba wax, montan wax, trimethylolpropanetribehenate, pentaelislitholtetrabehenate, pentaelislitholdiacetatedibehenate, glycerinetribehenate and 1,18-octadecanedioldistearate; polyalkanolesters such as tristearyltrimellitate and distearylmaleate; polyamidealkanate such as ethylenediaminebehenylamide; polyalkylamide such as tristearylamidetrimellitate; and dialkylketone such as distearylketone. Among these waxes including a carbonyl group, polyesteralkanate is preferably used.

The wax for use in the present invention usually has a melting point of from 40 to 160° C., preferably of from 50 to 120° C., and more preferably of from 60 to 90° C. A wax having a melting point less than 40° C. has an adverse effect on its high temperature preservability, and a wax having a melting point greater than 160° C. tends to cause cold offset of the resultant toner when fixed at a low temperature. In addition, the wax preferably has a melting viscosity of from 5 to 1,000 cps, and more preferably of from 10 to 100 cps when measured at a temperature higher than the melting point by 20° C. A wax having a melting viscosity greater than 1,000 cps makes it difficult to improve hot offset resistance and low temperature fixability of the resultant toner. The content of the wax in a toner is preferably from 0 to 40% by weight, and more preferably from 3 to 30% by weight.

The toner of the present invention may optionally include a charge controlling agent. Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc.

Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and image density of the toner images. These charge controlling agent and release agent can be kneaded upon application of heat together with a master batch pigment and a resin, can be added to toner constituents when dissolved and dispersed in an organic solvent, or can be fixed on the surface of a toner after a toner particle is formed.

As an external additive to subsidize the fluidity, developability and chargeability of a colored particle prepared in the present invention, besides an oxidized particulate material, inorganic particulate material and hydrophobized inorganic particulate material can be used together. It is preferable that the colored particle externally includes at least one hydrophobized inorganic particulate material having an average primary particle diameter of from 1 to 100 nm, and more preferably from 5 to 70 nm. Further, it is more preferable that at least one hydrophobized inorganic particulate material having an average primary particle diameter not greater than 20 nm and an inorganic particulate material having an average primary particle diameter not less than 30 nm. The external additive preferably has a specific surface area of from 20 to 500 $m^2/g$ when measured by a BET method.

Any known inorganic particulate materials and hydrophobized inorganic particulate materials can be used as the external additives. Specific examples of the external additives include particulate silica, hydrophobized silica, fatty acid metallic salts such as zinc stearate and aluminium stearate, metal oxides such as titania, alumina, tin oxide and antimony oxide, fluoropolymers, etc.

Particularly, the particulate hydrophobized silica, titania and alumina are preferably used. Specific examples of the particulate silica include HDK H 2000, HDK H 2000/4, HDK H 2050EP and HVK21 from Hoechst AG; and R972, R974, RX200, RY200, R202, R805 and R812 from Nippon Aerosil Co. Specific examples of the particulate titania include P-25 from Nippon Aerosil Co.; ST-30 and STT-65C-S from Titan Kogyo K.K.; TAF-140 from Fuji Titanium Industry Co., Ltd.; MT150W, MT-500B and MT-600b from Tayca Corp., etc. Specific examples of the particulate hydrophobized titanium oxide include T-805 from Nippon Aerosil Co.; STT-30A and STT-65S-S from Titan Kogyo K. K.; TAF-500T and TAF-1500T from Fuji Titanium Industry Co., Ltd.; MT-100S and MT100T from Tayca Corp.; IT-S from Ishihara Sangyo Kaisha Ltd., etc.

To prepare the particulate hydrophobized silica, titania or alumina, a hydrophilic particulate material is subjected to silane coupling agents such as methyltrimethoxy silane, methyltriethoxy silane and octylmethoxy silane. An inorganic particulate material optionally subjected to a silicone oil upon application of heat is preferably used.

Specific examples of the silicone oil include dimethyl silicone oil, methylphenyl silicone oil, chlorphenyl silicone oil, methylhydrogen silicone oil, alkyl modified silicone oil, fluorine modified silicone oil, polyether modified silicone oil, alcohol modified silicone oil, amino modified silicone oil, epoxy modified silicone oil, epoxy-polyether modified silicone oil, phenol modified silicone oil, carboxyl modified silicone oil, mercapto modified silicone oil, acryl modified silicone oil, methacryl modified silicone oil, α-methylstyrene modified silicone oil, etc. Specific examples of the inorganic particulate material include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. Particularly, the silica and titanium dioxide are preferably used.

The toner preferably includes the inorganic particulate material in an amount of from 0.3 to 3% by weight. The inorganic particulate material preferably has an average primary particle diameter not greater than 100 nm, and more preferably of from 3 to 70 nm. When less than 3 nm, the inorganic particulate material is buried in the toner. When greater than 100 nm, the surface of a photoreceptor is damaged.

Besides, polymer particulate materials, e.g., polystyrene, ester methacrylate and ester acrylate copolymers formed by soap-free emulsifying polymerization, suspension polymerization and dispersion polymerization; polycondensated particulate materials such as silicone, benzoguanamine and nylon; and polymerized particulate materials formed of thermosetting resins can be used.

Such fluidizers can be surface-treated with a surface treatment agent to increase the hydrophobicity to prevent deterioration of fluidity and chargeability even in an environment of high humidity. Specific examples of the surface treatment agent include a silane coupling agent, a sililating agent a silane coupling agent having an alkyl fluoride group, an organic titanate coupling agent, an aluminium coupling agent a silicone oil and a modified silicone oil.

The toner of the present invention may include a cleanability improver for removing a developer remaining on a photoreceptor and a first transfer medium after transferred. Specific examples of the cleanability improver include fatty acid metallic salts such as zinc stearate, calcium stearate and stearic acid; and polymer particles prepared by a soap-free emulsifying polymerization method such as polymethylmethacrylate particles and polystyrene particles. The polymer particles comparatively have a narrow particle diameter distribution and preferably have a volume-average particle diameter of from 0.01 to 1 μm.

The toner of the present invention may optionally include a particulate resin material. The particulate resin material preferably has a glass transition temperature (Tg) of from 40 to 100° C. and a weight-average molecular weight of from 9,000 to 200,000. When the glass transition temperature (Tg) is less than 40° C. and/or weight-average molecular weight is less than 9,000, storage stability of the resultant toner deteriorates, and blocking thereof occurs when stored and in an image developer. When the glass transition temperature (Tg) is greater than 100° C. and/or weight-average molecular weight is greater than 200,000, the particulate resin material impairs adherence of the resultant toner to a transfer paper and increase the fixable minimum temperature thereof.

The particulate resin material preferably has a residual ratio of from 0.5 to 5.0% by weight based on total weight of the toner. When less than 0.5% by weight, storage stability of the resultant toner deteriorates, and blocking thereof occurs when stored and in an image developer. When greater than 5.0% by weight, the particulate resin material prevents a wax from seeping to impair releasability of the resultant toner, resulting in occurrence of offset.

The residual ratio of the particulate resin material can be determined from a peak area measured by analyzing a material with a pyrolysis gas chromatographic mass analyzer. The mass analyzer is preferably used, but not limited thereto.

Any thermoplastic and thermosetting resins capable of forming an aqueous dispersion can be used as the particulate resin materials. Specific examples of the resins include vinyl resins, polyurethane resins, epoxy resins, polyester resins, polyamide resins, polyimide resins, silicon resins, phenol resins, melamine resins, urea resins, aniline resins, ionomer resins, polycarbonate resins, etc. These can be used alone or in combination. Among these resins, the vinyl resins, polyurethane resins, epoxy resin, polyester resins or their combinations are preferably used because an aqueous dispersion of a fine-spherical particulate resin material can easily be obtained.

Specific examples of the vinyl resins include single-polymerized or copolymerized vinyl monomers such as a styrene-ester(metha)acrylate resin, a styrene-butadiene copolymers, a (metha)acrylic acid-esteracrylate polymer, a styrene-acrylonitrile copolymer, a styrene-maleic acid anhydride copolymer and a styrene-(metha)acrylic acid copolymer.

It is essential that the toner of the present invention has a specific shape and a distribution thereof, and preferably has an average circularity of from 0.90 to 0.99. A toner having such an average circularity has a low-temperature fixability in a short time. An amorphous toner having an average circularity less than 0.90 and far from sphericity does not have a satisfactory transferability and does not produce high-quality images. A toner having an average circularity greater than 0.99 is almost a complete sphere and has poor cleanability.

The shape of the toner is suitably measured by an optical detection method of passing a suspension liquid including a particle through a plate-shaped imaging detector to detect and analyze an image of the particle. A peripheral length of a circle having an area equivalent to that of a projected image optically detected is divided by an actual peripheral length of the toner particle to determine the circularity of a toner. It is more preferable that the toner has an average circularity of from 0.94 to 0.99 to produce images having an appropriate density, a reproducibility and a high definition. To further improve the cleanability, the toner preferably has an average circularity of from 0.94 to 0.99 and particles having a circularity less than 0.94 in an amount not greater than 10%.

Specifically, the circularity of the toner is measured by a flow-type particle image analyzer FPIA-2000 from SYSMEX CORPORATION. A specific measuring method includes adding 0.1 to 0.5 ml of a surfactant, preferably an alkylbenzenesulfonic acid, as a dispersant in 100 to 150 ml of water from which impure solid materials are previously removed; adding 0.1 to 0.5 g of the toner in the mixture; dispersing the mixture including the toner with an ultrasonic disperser for 1 to 3 min to prepare a dispersion liquid having a concentration of from 3,000 to 10,000 pieces/μl; and measuring the toner shape and distribution with the above-mentioned measurer.

SF-1 and SF-2 (shape factors) for use in the present invention are determined by the following formulae after photographing 300 particles of the toner with an FE-SEM (S-4200) from Hitachi, Ltd. and analyzing the photographed image with an image analyzer Luzex AP from NIRECO Corp through an interface. SF-1 and SF-2 are preferably determined by using the S-4200 and Luzex AP, but are not limited thereto provided similar results can be obtained.

$$SF\text{-}1=(L^2/A)\times(\pi/4)\times 100$$

$$SF\text{-}2=(P^2/A)\times(1/4\pi)\times 100$$

wherein L is the maximum length of a toner; A is a projected area thereof; and P is the maximum peripheral length thereof.

When the toner is a true sphere, both SF-1 and SF-2 are 100. As they become larger than 100, the toner becomes more amorphous than spherical. Particularly, SF-1 represents the whole shape of a toner such as oval or sphere and SF-2 represents a surface concavity and convexity.

The toner of the present invention preferably has a volume-average particle diameter (Dv) of from 2 to 7 μm, and a ratio (Dv/Dn) to a number-average particle diameter (Dn) not greater than 1.25, and more preferably from 1.10 to 1.25. Such a toner has a good thermostable preservability, a good low-temperature fixability and a good hot offset resistance, and above all has a good glossiness when used in a full-color copier. Further, when used in a two-component developer, a particle diameter thereof less fluctuates even after the toner is consumed and fed for long periods, and the toner has a stable developability even after stirred in an image developer for long periods. When used as a one-component developer, a particle diameter thereof less fluctuates without filming over a developing roller and fusion bond to a blade forming a thin layer of the toner even after the toner is consumed and fed for long periods. Further, the toner has a good and stable developability even after stirred in an image developer for long periods. Further, when an inorganic particulate material, the surface of which is treated with both a fluorine-containing compound and a silicon-containing compound, is used as a fluidizer, the toner preferably has the above-mentioned particle diameter distribution against filming thereof due to the fluorine group.

Typically, it is said that the smaller the toner particle diameter, the more advantageous to produce high resolution and quality images. However, the small particle diameter of the toner is disadvantageous thereto to have transferability and cleanability. When the volume-average particle diameter is smaller than 4 μm, the resultant toner in a two-component developer melts and adheres to a surface of a carrier to deteriorate chargeability thereof when stirred for a long time in an image developer. When the toner is used in a one-component developer, toner filming over a developing roller and fusion bond of the toner to a blade forming a thin layer thereof tend to occur.

These phenomena also occur when a content of fine powder in the toner is larger than the scope of the present invention. When the average particle diameter is larger than the scope of the present invention, the resultant toner has a difficulty in producing high resolution and quality images. In addition, the resultant toner has a large variation of the particle diameters in many cases after the toner in a developer is consumed and fed for long periods. When Dv/Dn is greater than 1.25, these phenomena also occur.

The toner binder of the present invention can be prepared, for example, by the following method. Polyol (1) and polycarboxylic acid (2) are heated at a temperature of from 150 to 280° C. in the presence of a known catalyst such as tetrabutoxy titanate and dibutyltinoxide. Then water generated is removed, under a reduced pressure if desired, to prepare a polyester resin having a hydroxyl group. Then the polyester resin is reacted with polyisocyanate (3) at a temperature of from 40 to 140° C. to prepare a prepolymer (A) having an isocyanate group. The toner of the present invention can be prepared by the following method, but the method is not limited thereto.

A particulate resin material is previously added to an aqueous phase. The aqueous phase may include water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone.

The toner of the present invention can be prepared by reacting a dispersion formed of the prepolymer (A) having an isocyanate group with (B) or by using the modified polyester (i) previously prepared. As a method of stably preparing a dispersion formed of the urea-modified polyester or the prepolymer (A) in an aqueous medium, a method of including toner constituents such as the modified polyester (i) or the prepolymer (A) into an aqueous medium and dispersing them upon application of shear stress is preferably used.

The prepolymer (A) and other toner constituents such as colorants, master batch pigments, release agents, charge controlling agents, unmodified polyester resins (LL), etc. may be added into an aqueous medium at the same time when the dispersion is prepared. However, it is preferable that the toner constituents are previously mixed and then the mixed toner constituents are added to the aqueous liquid at the same time.

In addition, colorants, release agents, charge controlling agents, etc., are not necessarily added to the aqueous dispersion before particles are formed, and may be added thereto after particles are prepared in the aqueous medium. A method of dyeing particles previously formed without a colorant by a known dying method can also be used.

The dispersion method is not particularly limited, and low speed shearing methods, high-speed shearing methods, friction methods, high-pressure jet methods, ultrasonic methods, etc. can be used. Among these methods, high-speed shearing methods are preferably used because particles having a particle diameter of from 2 to 20 μm can be easily prepared. At this point, the particle diameter (2 to 20 μm) means a particle diameter of particles including a liquid). When a high-speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C. When the temperature is relatively high, the modified polyester (i) or prepolymer (A) can easily be dispersed because the dispersion formed thereof has a low viscosity.

The content of the aqueous medium to 100 parts by weight of the toner constituents including the modified polyester (i) or prepolymer (A) is typically from 50 to 2,000 parts by weight, and preferably from 100 to 1,000 parts by weight. When the content is less than 50 parts by weight, the dispersion of the toner constituents in the aqueous medium is not satisfactory, and thereby the resultant toner particles do not have a desired particle diameter. In contrast, when the content is greater than 2,000, the production cost increases. A dispersant can preferably be used to prepare a stably dispersed dispersion including particles having a sharp particle diameter distribution.

Specific examples of the dispersants used to emulsify and disperse an oil phase for a liquid including water in which the toner constituents are dispersed include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di(octylaminoethyle) glycin, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium-{omega-fluoroalkanoyl(C6-C8)N-ethylamino}-1-propane sulfonate, fluoroalkyl(C11-C20) carboxylic acids and their metal salts, perfluoroalkylcarboxylic acids and their metal salts, perfluoroalkyl (C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl (C6-C10)-N-ethylsulfonylglycin, monoperfluoroalkyl(C6-C16) ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants, which can disperse an oil phase including toner constituents in water, include primary, secondary and tertiary aliphatic amines having a fluoroalkyl group, aliphatic quaternary ammonium salts such as erfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SURFLONS-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

In addition, inorganic compound dispersants such as tricalcium phosphate, calcium carbonate, titanium oxide, colloidal silica and hydroxyapatite which are hardly insoluble in water can also be used.

Further, it is possible to stably disperse toner constituents in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethyleneimine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When an acid such as calcium phosphate or a material soluble in alkaline is used as a dispersant, the calcium phosphate is dissolved with an acid such as a hydrochloric acid and washed with water to remove the calcium phosphate from the toner particle. Besides this method, it can also be removed by an enzymatic hydrolysis.

When a dispersant is used, the dispersant may remain on a surface of the toner particle. However, the dispersant is preferably washed and removed after the elongation and/or crosslinking reaction of the prepolymer with amine for the chargeability of the resultant toner.

The elongation and/or crosslinking reaction time depend on reactivity of an isocyanate structure of the prepolymer (A) and amine (B), but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used.

To remove an organic solvent from the emulsified dispersion, a method of gradually raising a temperature of the whole dispersion to completely remove the organic solvent in the droplet by vaporizing can be used. Otherwise, a method of spraying the emulsified dispersion in a dry air, completely removing a water-insoluble organic solvent in the droplet to form toner particles and removing a water dispersant by vaporizing can also be used. As the dry air, an atmospheric air, a nitrogen gas, carbon dioxide gas, a gaseous body in which a combustion gas is heated, and particularly various aerial currents heated to have a temperature not less than a boiling point of a solvent used are typically used. A spray dryer, a belt dryer and a rotary kiln can sufficiently remove the organic solvent in a short time.

In addition, a method of blowing air with a rotary evaporator to remove the organic solvent can also be used.

Then, the emulsified dispersion is roughly separated with a centrifugal separator, and repeatedly washed in a washing tank and dried with a hot air drier to prepare a mother toner. Then, an aging process is preferably included to control a hollow status in the toner. The aging process is preferably performed at 30 to 55° C., and more preferably at 40 to 50° C. for 5 to 36 hrs, and more preferably for 10 to 24 hrs.

When the emulsified dispersion is washed and dried while maintaining a wide particle diameter distribution thereof, the dispersion can be classified to have a desired particle diameter distribution.

A cyclone, a decanter, a centrifugal separation, etc. can remove particles in a dispersion liquid. A powder after the dispersion liquid is dried can be classified, but the liquid is preferably classified in terms of efficiency. Unnecessary fine and coarse particles can be recycled to a kneading process to form particles. The fine and coarse particles may be wet when recycled.

A dispersant is preferably removed from a dispersion liquid, and more preferably removed at the same time when the above-mentioned classification is performed.

Heterogeneous particles such as release agent particles, charge controlling particles, fluidizing particles and colorant particles can be mixed with a toner powder after dried. Release of the heterogeneous particles from composite particles can be prevented by giving a mechanical stress to a mixed powder to fix and fuse them on a surface of the composite particles.

Specific methods include a method of applying an impact strength on a mixture with a blade rotating at a high-speed, a method of putting a mixture in a high-speed stream and accelerating the mixture such that particles thereof collide each other or composite particles thereof collide with a collision board, etc. Specific examples of the apparatus include an ONG MILL from Hosokawa Micron Corp., a modified I-type mill having a lower pulverizing air pressure from Nippon Pneumatic Mfg. Co., Ltd., a hybridization system from Nara Machinery Co., Ltd., a Kryptron System from Kawasaki Heavy Industries, Ltd., an automatic mortar, etc.

Finally, an external additive such as an inorganic particulate material and the mother toner are mixed by a HENSCHEL mixer and coarse toner particles are removed by a ultrasonic sifter to prepare a final toner.

The toner of the present invention can be used for a two-component developer in which the toner is mixed with a magnetic carrier. The content of the toner is preferably from 1 to 10 parts by weight per 100 parts by weight of the carrier. Suitable carriers for use in the two component developer include known carrier materials such as iron powders, ferrite powders, magnetite powders, magnetic resin carriers, which have a particle diameter of from about 20 to about 200 μm.

The carrier may be coated by a resin. Specific examples of such resins to be coated on the carriers include amino resins such as a urea-formaldehyde resin, a melamine resin, a benzoguanamine resin, a urea resins, and a polyamide resin, and an epoxy resin. In addition, vinyl or vinylidene resins such as an acrylic resin, a polymethylmethacrylate resin, a polyacrylonitirile resin, a polyvinyl acetate resin, a polyvinyl alcohol resin, a polyvinyl butyral resin, a polystyrene resin, a styrene-acrylic copolymer; halogenated olefin resins such as a polyvinyl chloride resin; polyester resins such as a polyethyleneterephthalate resin and a polybutyleneterephthalate resin; polycarbonate resins; polyethylene resins; polyvinyl fluoride resins; polyvinylidene fluoride resins; polytrifluoroethylene resins; polyhexafluoropropylene resins; vinylidenefluoride-acrylate copolymers; vinylidenefluoride-vinylfluoride copolymers; copolymers of tetrafluoroethylene; vinylidenefluoride and other monomers including no fluorine atom; and silicone resins, etc. can be used.

An electroconductive powder may optionally be included in the toner. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The toner of the present invention can also be used as a one-component magnetic or non-magnetic developer without a carrier.

In the present invention, an intermediate transferer can be used. FIG. 1 of both U.S. Pat. No. 7,258,959 and U.S. 2005/0089786 is a schematic view illustrating an embodiment of a full-color copier using a developing belt. As shown in FIG. 1 of U.S. 2005/0089786, around a photoreceptor drum (hereinafter referred to as a photoreceptor) as an image bearer 10, a charging roller as a charger 20, an irradiator 30, a cleaner having a cleaning blade 60, a discharge lamp as a discharger 70, an image developer 40 and a intermediate transferer 50 are arranged. The intermediate transferer 50 is suspended by plural suspension rollers 51 and endlessly driven by a driver such as motor (not shown) in a direction indicated by an arrow. Some of the suspension rollers 51 are combined with roles of transfer bias rollers feeding a transfer bias to the intermediate transferer and a predetermined transfer bias is applied thereto from an electric source (not shown). A cleaner having a cleaning blade 90 cleaning the intermediate transferer 50 is also arranged. A transfer roller 80 transferring a toner image onto a transfer paper 100 as a final transferer is arranged facing the intermediate transferer 50, to which a transfer bias is applied from an electric source (not shown). Around the intermediate transferer 50, a corona charger 52 is arranged as a charger.

The image developer 40 includes a developing belt 41 as a developer bearer, a black (Bk) developing unit 45Bk, a yellow (Y) developing unit 45Y, a magenta (M) developing unit 45M and a cyan (C) developing unit 45C around the developing belt 41. The developing belt 41 is extended over plural belt rollers, endlessly driven by a driver such as motor (not shown) in a direction indicated by an arrow and driven at almost a same speed as the photoreceptor 10 at a contact point therewith.

Since each developing unit has a same configuration, only Bk developing unit 50Bk will be explained, and explanations of other developing units 50Y, 50M and 50C are omitted.

The developing unit 50Bk includes a developer tank 42Bk including a high-viscosity and high-concentration liquid developer including a toner and a carrier liquid, a scoop roller 43Bk with a bottom dipped in the liquid developer in the developer tank 42Bk and an application roller 44Bk applying a thin layer of the developer scooped by the scoop roller 43Bk to the developing belt 41. The application roller 44Bk has an electroconductivity and a predetermined bias is applied thereto from an electric source (not shown).

In the present invention, besides the embodiment of a full-color copier in FIG. 1 of above-discussed U.S. Pat. No. 7,258,959 and U.S. 2005/0089786, an embodiment of a full-color copier in FIG. 2 of above-discussed U.S. 2005/0089786, wherein developing units 45 for each color are located around a photoreceptor 10 may be used.

In FIG. 1, after the photoreceptor 10 is uniformly charged rotating in a direction indicated by an arrow, the irradiator 30 irradiates the photoreceptor 10 with an original imagewise light from an optical system (not shown) to form an electrostatic latent image thereon. The electrostatic latent image is developed by the image developer 40 to form a visual toner image thereon. The developer thin layer on the developing belt 41 is released therefrom as it is and transferred onto a part the electrostatic latent image is formed on. The toner image developed by the image developer 40 is transferred onto the surface of the intermediate transferer 50 (first transfer) driven at a same speed as that of the photoreceptor 10 at a contact point (first transfer area) therewith. When 3 or 4 colors are overlaid on the intermediate transferer 50 to form a full-color image thereon.

In the rotating direction of the intermediate transferer 50, the corona charger 52 charging the toner image thereon is located in a downstream of the contact point between the photoreceptor 10 and the intermediate transferer 50, and in an upstream of a contact point between the intermediate transferer 50 and the transfer paper 100. The corona charger 52 applies a sufficient charge having a same polarity as that of the toner particle to the toner image so as to be transferred well onto the transfer paper 100. After the toner image is charged by the corona charger 52, the toner image is transferred at a time by a transfer bias from the transfer roller 80 onto the transfer paper 100 fed from a paper feeder (not shown) in a direction indicated by an arrow. Then, the transfer paper 100 the toner image is transferred onto is separated from the photoreceptor 10 by a separator (not shown). After the toner image is fixed thereon by a fixer (not shown), the transfer paper 100 is discharged from the copier. On the other hand, untransferred toner is removed from the photoreceptor 10 by a cleaner 60 after the toner image is transferred, and discharged by the discharge lamp 70 to be ready for a following charge.

The intermediate transferer preferably has a static friction coefficient of from 0.1 to 0.6, and more preferably from 0.3 to 0.5. In addition, the intermediate transferer preferably has a volume resistance of from several to $10^3$ Ωcm. When the intermediate transferer has a volume resistance of from several to $10^3$ Ωcm, it is prevented that the intermediate transferer itself is charged and a charge is difficult to remain thereon to prevent an uneven second transfer. Further, a transfer bias can easily be applied thereto.

Any known materials can be used therefor, and specific examples thereof include:

(1) a single layer belt formed of a material having high Young's modulus (tensile elasticity) such as PC (polycarbonate), PVDF (polyvinylidenefluoride), PAT (polyalkyleneterephthalate), a mixture of PC and PAT, a mixture of ETFE (ethylenetetrafluoroethylene copolymer) and PC, a mixture of ETFE and PAT, a mixture of PC and PAT and a thermosetting polyimide in which carbon black dispersed, which has a small transformed amount against a stress when an image is formed;

(2) a two or three layer belt including a surface layer or an intermediate layer based on the above-mentioned belt having high Young's modulus, which prevents hollow line images due to a hardness of the single layer belt; and (3) a belt formed of a rubber and an elastomer having comparatively a low Young's modulus, which has an advantage of scarcely producing hollow line images due to its softness, and being low-cost because of not needing a rib or a meandering inhibitor when the belt is wider than a driving roller and an extension roller such that an elasticity of an edge of the belt projecting therefrom prevents the meandering.

The intermediate transfer belt is conventionally formed of a fluorocarbon resin, a polycarbonate resin and a polyimide resin. However, an elastic belt which is wholly or partially an elastic member is used recently.

A full-color image is typically formed of 4 colored toners. The full-color image includes 1 to 4 toner layers. The toner layer receives a pressure from a first transfer (transfer from a photoreceptor to an intermediate transfer belt) and a second transfer (from the intermediate transfer belt to a sheet), and agglutinability of the toner increases, resulting in production of hollow letter images and edgeless solid images. Since a resin belt has a high hardness and does not transform according to a toner layer, it tends to compress the toner layer, resulting in production of hollow letter images.

Recently, demands for forming an image on various sheets such as a Japanese paper and a sheet purposefully having a concavity and convexity are increasing. However, a paper having a poor smoothness tends to have an air gap with a toner when transferred thereon and hollow images tend to be produced thereon. When a transfer pressure of the second transfer is increased to increase an adhesion of the toner to the paper, agglutinability of the toner increases, resulting in production of hollow letter images.

The elastic belt transforms according to a toner layer and a sheet having a poor smoothness at a transfer point. Since the elastic belt transforms following to a local concavity and convexity, it adheres a toner to a paper well without giving an excessive transfer pressure to a toner layer, and therefore a transfer image having good uniformity can be formed even on a sheet having a poor smoothness without hollow letter images.

Specific examples of the resin for the elastic belt include, but are not limited to, polycarbonate; fluorocarbon resins such as ETFE and PVDF; styrene resins (polymers or copolymers including styrene or a styrene substituent) such as polystyrene, chloropolystyrene, poly-α-methylstyrene, a styrene-butadiene copolymer, a styrene-vinylchloride copolymer, a styrene-vinylacetate copolymer, a styrene-maleate copolymer, a styrene-esteracrylate copolymer (a styrene-methylacrylate copolymer, a styrene-ethylacrylate copolymer, a styrene-butylacrylate copolymer, a styrene-octylacrylate copolymer and a styrene-phenylacrylate copolymer), a styrene-estermethacrylate copolymer (a styrene-methylmethacrylate copolymer, a styrene-ethylmethacrylate copolymer and a styrene-phenylmethacrylate copolymer), a styrene-α-methylchloroacrylate copolymer and a styrene-acrylonitrile-esteracrylate copolymer; a methylmethacrylate resin; a butyl methacrylate resin; an ethyl acrylate resin; a butyl acrylate resin; a modified acrylic resin such as a silicone-modified acrylic resin, a vinylchloride resin-modified acrylic resin and an acrylic urethane resin; a vinylchloride resin; a styrene-vinylacetate copolymer; a vinylchloride-vinyl-acetate copolymer; a rosin-modified maleic acid resin; a phenol resin; an epoxy resin; a polyester resin; a polyester polyurethane resin; polyethylene; polypropylene; polybutadiene; polyvinylidenechloride; an ionomer resin; a polyurethane resin; a silicone resin; a ketone resin; an ethylene-ethylacrylate copolymer; a xylene resin; a polyvinylbutyral resin; a polyamide resin; a modified-polyphenyleneoxide resin, etc. These can be used alone or in combination.

Specific examples of an elastic rubber and an elastomer include, but are not limited to, a butyl rubber, a fluorinated rubber, an acrylic rubber, EPDM, NBR, an acrylonitrile-butadiene-styrene natural rubber, an isoprene rubber, a styrene-butadiene rubber, a butadiene rubber, an ethylene-propylene rubber, an ethylene-propylene terpolymer, a chloroprene rubber, chlolosulfonated polyethylene, chlorinated polyethylene, a urethane rubber, syndiotactic 1,2-polybutadiene, an epichlorohydrin rubber, a silicone rubber, a fluorine rubber, a polysulfide rubber, a polynorbornene rubber, a hydrogenated nitrile rubber; and a thermoplastic elastomer such as a polystyrene elastomer, a polyolefin elastomer, a polyvinylchloride elastomer, a polyurethane elastomer, a polyamide elastomer, a polyurea elastomer, a polyester elastomer and a fluorocarbon resin elastomer; etc. These can be used alone or in combination.

Specific examples of a conductant controlling a resistivity include, but are not limited to, a metallic powder such as carbon black, graphite, aluminium and nickel; and an electroconductive metal oxide such as a tin oxide, a titanium oxide, a antimony oxide, an indium oxide, kalium titanate, an antimony oxide-tin oxide complex oxide and an indium oxide-tin oxide complex oxide. The electroconductive metal oxide may be coated with an insulative particulate material such as barium sulfate, magnesium silicate and calcium carbonate.

A surface layer material of the elastic material does not contaminate photoreceptor and decrease surface friction of a transfer belt to increase cleanability and second transferability of a toner. For example, one, or two or more of a polyurethane resin, a polyester resin and an epoxy resin can reduce a surface energy and increase a lubricity. A powder or a particulate material of one, or two or more of a fluorocarbon resin, a fluorine compound, fluorocarbon, a titanium dioxide, silicon carbide can be also used. A material having a surface layer including many fluorine atoms when heated, and having a small surface energy such as a fluorinated rubber can also be used.

The belt can be prepared by the following methods, but the methods are not limited thereto and the belt is typically prepared by combinations of plural methods.

(1) A centrifugal forming method of feeding materials into a rotating cylindrical mold.

(2) A spray coating method of spraying a liquid coating to form a film.

(3) A dipping method of dipping a cylindrical mold in a material solution.

(4) A casting method of casting materials into an inner mold and an outer mold.

(5) A method of winding a compound around a cylindrical mold to perform a vulcanizing grind.

As a method of preventing an elongation of the elastic belt, a method of forming a rubber layer on a resin layer having a hard center with less elongation and a method of including an elongation inhibitor in a layer having a hard center are used.

Specific examples of the elongation inhibitor include, but are not limited to, a natural fiber such as cotton and silk; a synthetic fiber such as a polyester fiber, a nylon fiber, an acrylic fiber, a polyolefin fiber, a polyvinylalcohol fiber, a polyvinylchloride fiber, a polyvinylidenechloride fiber, a polyurethane fiber, a polyacetal fiber, a polyfluoroethylene fiber and a phenol fiber; an inorganic fiber such as a carbon fiber, a glass fiber and a boron fiber; and a metallic fiber such as an iron fiber and a copper fiber. These can be used alone or in combination in form of a fabric or a filament.

Any twisting methods such as twisted one or plural filaments, a piece twist yarn, a ply yarn and two play yarn can be used. The filament can be subject to an electroconductive treatment.

Any fabrics such as a knitted fabric and a mixed weave fabric can be used, and can be subject to an electroconductive treatment.

Specific examples of a method of preparing a layer having a hard center include a method of covering a cylindrically-woven fabric over a metallic mold and forming a coated layer thereon; a dipping a cylindrically-woven fabric in a liquid rubber and forming a coated layer on one side or both sides thereof; and a method of spirally winding a thread around a metallic mold and forming a coated layer thereon.

When the elastic layer is too thick, expansion and contraction of the surface becomes large and tends to have a crack, although depending on a hardness thereof. When the expansion and contraction of the surface becomes large, the resultant image largely expands and contracts. Therefore, it is not preferable that the elastic layer is too thick, but it preferably has a thickness not less than 1 mm.

A tandem-type electrophotographic image forming apparatus includes an apparatus using a direct transfer method of sequentially transferring an image on each photoreceptor 1 with a transferer 2 onto a sheet s fed by a sheet feeding belt 3 as shown in FIG. 3 of above-discussed U.S. Pat. No. 7,258,959 and U.S. 2005/0089786, and an apparatus using an indirect transfer method of sequentially transferring an image on each photoreceptor 1 with a first transferer 2 onto an intermediate transferer 4 and transferring the image thereon onto a sheet s with a second transferer 5. The second transferer 5 has the shape of a belt, and may have the shape of a roller.

The direct transfer method has a disadvantage of being large toward a sheet feeding direction because a paper feeder 6 is located in an upstream of a tandem-type image forming apparatus T having photoreceptors 1 in line, and a fixer 7 in a downstream thereof.

The indirect method can be downsized because of being able to freely locate the second transferer, and can locate a paper feeder 6 and a fixer 7 together with a tandem-type image forming apparatus T.

To avoid being large toward a sheet feeding direction, the former method locates the fixer 7 close to the tandem-type image forming apparatus T. Therefore, the sheet s cannot flexibly enter the fixer 7, and an impact thereof to the fixer 7 when entering the fixer 7 and a difference of feeding speed of the sheet s between when passing through the fixer 7 and when fed by a feeding belt tend to affect an image formation in the upstream.

The latter method can flexibly locate the fixer 7, and therefore the fixer 7 scarcely affects the image formation.

Therefore, recently, the tandem-type electrophotographic image forming apparatus using an indirect transfer method is widely used.

In this type of full-color electrophotographic image forming apparatus, as shown in FIG. 4 of above-discussed U.S. 2005/0089786, a photoreceptor cleaner 8 removes a residual toner on a photoreceptor 1 to clean the surface thereof after a first transfer and ready for another image formation. In addition, an intermediate transferer cleaner 9 removes a residual toner on an intermediate transferer 4 to clean the surface thereof after second transfer and ready for another image formation.

FIG. 5 of above-discussed U.S. Pat. No. 7,258,959 and U.S. 2005/0089786 is a schematic view illustrating an embodiment of a tandem-type electrophotographic image forming apparatus using an indirect transferer. Numeral 100 is a copier, 200 is a paper feeding table, 300 is a scanner on the copier 100 and 400 is an automatic document feeder (ADF) on the scanner 300. The copier 100 includes an intermediate transferer 10 having the shape of an endless belt.

The intermediate transferer 10 is suspended by three suspension rollers 14, 15 and 16 and rotatable in a clockwise direction.

On the left of the suspension roller 15, an intermediate transferer cleaner 17 is located to remove a residual toner on an intermediate transferer 10 after an image is transferred.

Above the intermediate transferer 10, 4 image forming units 18 for yellow, cyan, magenta and black colors are located in line from left to right along a transport direction of the intermediate transferer 10 to form a tandem image forming apparatus 20.

Above the tandem image forming apparatus 20, an image developer 21 is located. On the opposite side of the tandem image forming apparatus 20 across the intermediate transferer 10, a second transferer 22 is located. The second transferer 22 includes a an endless second transfer belt 24 and two rollers 23 suspending the endless second transfer belt 24, and is pressed against the suspension roller 16 across the intermediate transferer 10 and transfers an image thereon onto a sheet.

Beside the second transferer 22, a fixer 25 fixing a transferred image on the sheet is located. The fixer 25 includes an endless belt 26 and a pressure roller 27 pressed against the belt.

The second transferer 22 also includes a function of transporting the sheet an image is transferred on to the fixer 25. As the second transferer 22, a transfer roller and a non-contact charger may be used. However, they are difficult have such a function of transporting the sheet.

In FIG. 5, below the second transferer 22 and the fixer 25, a sheet reverser 28 reversing the sheet to form an image on both sides thereof is located in parallel with the tandem image forming apparatus 20.

An original is set on a table 30 of the ADF 400 to make a copy, or on a contact glass 32 of the scanner 300 and pressed with the ADF 400.

When a start switch (not shown) is put on, a first scanner 33 and a second scanner 34 scans the original after the original set on the table 30 of the ADF 400 is fed onto the contact glass 32 of the scanner 300, or immediately when the original set thereon. The first scanner 33 emits light to the original and reflects reflected light therefrom to the second scanner 34. The second scanner further reflects the reflected light to a reading sensor 36 through an imaging lens 35 to read the original.

When a start switch (not shown) is put on, a drive motor (not shown) rotates one of the suspension rollers 14, 15 and 16 such that the other two rollers are driven to rotate, to rotate the intermediate transferer 10. At the same time, each of the image forming units 18 rotates the photoreceptor 40 and forms a single-colored image, i.e., a black image, a yellow image, a magenta image and cyan image on each photoreceptor 40. The single-colored images are sequentially transferred onto the intermediate transferer 10 to form a full-color image thereon.

On the other hand, when start switch (not shown) is put on, one of paper feeding rollers 42 of paper feeding table 200 is selectively rotated to take a sheet out of one of multiple-stage paper cassettes 44 in a paper bank 43. A separation roller 45 separates sheets one by one and feed the sheet into a paper feeding route 46, and a feeding roller 47 feeds the sheet into a paper feeding route 48 of the copier 100 to be stopped against a resist roller 49.

Alternatively, a paper feeding roller 50 is rotated to take a sheet out of a manual feeding tray 51, and a separation roller 52 separates sheets one by one and feed the sheet into a paper feeding route 53 to be stopped against a resist roller 49.

Then, in timing with a synthesized full-color image on the intermediate transferer 10, the resist roller 49 is rotated to feed the sheet between the intermediate transferer 10 and the second transferer 22, and the second transferer transfers the full-color image onto the sheet.

The sheet the full-color image is transferred thereon is fed by the second transferer 22 to the fixer 25. The fixer 25 fixes the image thereon upon application of heat and pressure, and the sheet is discharged by a discharge roller 56 onto a catch tray 57 through a switch-over click 55. Alternatively, the switch-over click 55 feeds the sheet into the sheet reverser 28 reversing the sheet to a transfer position again to form an image on the backside of the sheet, and then the sheet is discharged by the discharge roller 56 onto the catch tray 57.

On the other hand, the intermediate transferer 10 after transferring an image is cleaned by the intermediate transferer cleaner 17 to remove a residual toner thereon after the image is transferred, and ready for another image formation by the tandem image forming apparatus 20.

The resist roller 49 is typically earthed, and a bias may be applied thereto remove paper dust from the sheet.

In the tandem image forming apparatus 20, each of the image forming units 18 includes, as shown in FIG. 6 of above-discussed U.S. 2005/0089786, a charger 60, an image developer 61, a first transferer 62, a photoreceptor cleaner 63 and a discharger 64 around a drum-shaped photoreceptor 40.

Further, the image forming apparatus can detachably be equipped with a process cartridge including an image developer and a photoreceptor, and at least one of a charger and a cleaner. FIG. 10 of above-discussed U.S. Pat. No. 7,258,959 is a schematic view illustrating an embodiment of the process cartridge of the present invention, wherein numeral 82 is a photoconductor, 83 is a charger, 85 is a cleaner, 84 is an image developer and 81 represents a whole process cartridge.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Organic Particulate Emulsion 683 parts of water, 11 parts of a sodium salt of an adduct of a sulfuric ester with ethyleneoxide methacrylate (ELEMINOL RS-30 from Sanyo Chemical Industries, Ltd.), 83 parts of styrene, 166 parts of methacrylate, 110 parts of butylacrylate and 1 part of persulfate ammonium were mixed in a reactor vessel including a stirrer and a thermometer, and the mixture was stirred for 30 min at 3,800 rpm to prepare a white emulsion therein. The white emulsion was heated to have a temperature of 75° C. and reacted for 4 hrs. Further, 30 parts of an aqueous solution of persulfate ammonium having a concentration of 1% were added thereto and the mixture was reacted for 6 hrs at 75° C. to prepare an aqueous dispersion [particulate dispersion 1] of a vinyl resin (a copolymer of a sodium salt of an adduct of styrene-methacrylate-butylacrylate-sulfuric ester with ethyleneoxide methacrylate). The [particulate dispersion 1] was measured by LA-920 to find a volume-average particle diameter thereof was 110 nm. A part of the [particulate dispersion 1] was dried to isolate a resin component therefrom. The resin component had a Tg of 58° C. and a weight-average molecular weight of 130,000.

<Preparation of Aqueous Phase>

990 parts of water, 83 parts of the [particulate dispersion 1], 37 parts of an aqueous solution of sodium dodecyldiphenyletherdisulfonate having a concentration of 48.5% (ELEMINOL MON-7 from Sanyo Chemical Industries, Ltd.) and 90 parts of ethyl acetate were mixed and stirred to prepare a lacteous liquid an [aqueous phase 1].

<Preparation of Low-Molecular-Weight Polyester>

229 parts of an adduct of bisphenol A with 2 moles of ethyleneoxide, 529 parts of an adduct of bisphenol A with 3 moles of propyleneoxide, 208 parts terephthalic acid, 46 parts of adipic acid and 2 parts of dibutyltinoxide were polycondensated in a reactor vessel including a cooling pipe, a stirrer and a nitrogen inlet pipe for 11 hrs at a normal pressure and 230° C. Further, after the mixture was depressurized by 10 to 15 mm Hg and reacted for 5 hrs, 44 parts of trimellitic acid anhydride were added thereto and the mixture was reacted for 4 hrs at a normal pressure and 180° C. to prepare a [low-molecular-weight polyester 1]. The [low-molecular-weight polyester 1] had a number-average molecular weight of 7,800, a weight-average molecular weight of 16,500, a Tg of 46° C. and an acid value of 25.

<Preparation of Intermediate Polyester>

682 parts of an adduct of bisphenol A with 2 moles of ethyleneoxide, 81 parts of an adduct of bisphenol A with 2 moles of propyleneoxide, 283 parts terephthalic acid, 22 parts of trimellitic acid anhydride and 2 parts of dibutyltinoxide were mixed and reacted in a reactor vessel including a cooling pipe, a stirrer and a nitrogen inlet pipe for 8 hrs at a normal pressure and 230° C. Further, after the mixture was depressurized to 10 to 15 mm Hg and reacted for 5 hrs to prepare an [intermediate polyester 1]. The [intermediate polyester 1] had a number-average molecular weight of 3,200, a weight-average molecular weight of 10,300, a Tg of 54° C. and an acid value of 0.5 and a hydroxyl value of 52.

<Preparation of Prepolymer>

Next, 410 parts of the [intermediate polyester 1], 89 parts of isophoronediisocyanate and 500 parts of ethyl acetate were reacted in a reactor vessel including a cooling pipe, a stirrer and a nitrogen inlet pipe for 5 hrs at 100° C. to prepare a [prepolymer 1]. The [prepolymer 1] included a free isocyanate in an amount of 1.53% by weight.

<Preparation of Ketimine>

170 parts of isophorondiamine and 75 parts of methyl ethyl ketone were reacted at 50° C. for 4 hrs in a reaction vessel including a stirrer and a thermometer to prepare a [ketimine compound 1]. The [ketimine compound 1] had an amine value of 417.

<Preparation of Masterbatch (MB)>

300 parts of methyl ethyl ketone, 500 parts of the yellow pigment (C.I. PIGMENT YELLOW 155) having the formula (1) and different particle diameters each other and 500 parts of a polyester resin were mixed by a Henschel mixer from Mitsui Mining Co., Ltd. After the mixture was kneaded by a two-roll mill having a surface temperature of 110° C. for 1 hr, the mixture was extended by applying pressure, cooled and pulverized by a pulverizer to prepare [masterbatches 1 to 6] shown in Table 1.

TABLE 1

| | Colorant (1) | Shape (TEM image) | Median diameter (μm) | Colorant (2) | Median diameter (μm) | (1)/(2) |
|---|---|---|---|---|---|---|
| MB1 | Pigment 1 | Granular to spicular | 0.08 | Pigment 4 | 0.03 | 30/70 |
| MB2 | Pigment 2 | Granular to spicular | 0.10 | " | 0.03 | 30/70 |
| MB3 | Pigment 3 | Granular to spicular | 0.11 | " | 0.03 | 50/50 |
| MB4 | Pigment 2 | Granular to spicular | 0.10 | " | 0.03 | 60/40 |
| MB5 | Pigment 4 | Granular to spicular | 0.03 | — | — | 100/0 |
| MB6 | Pigment 5 | Granular to spicular | 0.14 | Pigment 4 | 0.03 | 10/90 |

<Preparation of Pigment and Wax Dispersion>

378 parts of the [low-molecular-weight polyester 1], 100 parts of carnauba wax and 947 parts of ethyl acetate were mixed in a reaction vessel including a stirrer and a thermometer. The mixture was heated to have a temperature of 80° C. while stirred. After the temperature of 80° C. was maintained for 5 hrs, the mixture was cooled to have a temperature of 30° C. in an hour. Then, 500 parts of the [master batch 1] and 500 parts of ethyl acetate were added to the mixture and mixed for 1 hr to prepare a [material solution 1].

1,324 parts of the [material solution 1] were transferred into another vessel, and the carbon black and wax therein were dispersed by a beads mill (Ultra Visco Mill from IMECS CO., LTD.) for 3 passes under the following conditions:

liquid feeding speed of 1 kg/hr; peripheral disc speed of 6 m/sec; and filling zirconia beads having diameter of 0.5 mm for 80% by volume.

Next, 1,324 parts of an ethyl acetate solution of the [low-molecular-weight polyester 1] having a concentration of 65% were added to the [material solution 1] and the mixture was stirred by the beads mill for 2 passes under the same conditions to prepare a [pigment and wax dispersion 1]. The [pigment and wax dispersion] had a solid content concentration of 50% at 130° C. for 30 min.

<Emulsification⇒De-solvent>

749 parts of the [pigment and wax dispersion 1], 115 parts of the [prepolymer 1] and 2.9 parts of the [ketimine compound 1] were mixed in a vessel by a TK-type homomixer from Tokushu Kika Kogyo Co., Ltd. at 5,000 rpm for 2 min. 1,200 parts of the [aqueous phase 1] were added to the mixture and mixed by the TK-type homomixer at 13,000 rpm for 25 min to prepare an [emulsified slurry 1].

The [emulsified slurry 1] was put in a vessel including a stirrer and a thermometer. After a solvent was removed from the emulsified slurry 1 at 30° C. for 8 hrs, the slurry was aged at 40° C. for 24 hrs to prepare a [dispersion slurry 1].

<Charge Control>

After 100 parts of the dispersion slurry 1 was solid-liquid separated by a centrifugal separation, 100 parts of pure ion-exchanged water were added thereto again, and the mixture was mixed by a TK-type homomixer at 12,000 rpm for 10 min and centrifugalized again, which was repeated three times. A methanol solution including a fluorine quaternary ammonium salt compound having the following formula (2) in an amount of 5% by weight as added to the solid content in an amount of 0.1% by weight, and the mixture was stirred for 10 min to absorb the fluorine quaternary ammonium salt compound on the surface of each particle for charge control.

(2)

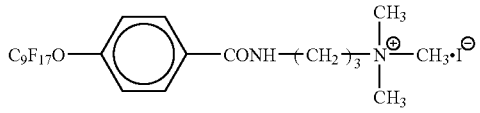

<Washing⇒Drying>

After the [dispersion slurry 1] was filtered under reduced pressure, 100 parts of ion-exchange water were added to the filtered cake and mixed by the TK-type homomixer at 12,000 rpm for 10 min, and the mixture was filtered.

Further, 100 parts of an aqueous solution of 10% sodium hydrate were added to the filtered cake and mixed by the TK-type homomixer at 12,000 rpm for 10 min, and the mixture was filtered under reduced pressure.

Further, 100 parts of 10% hydrochloric acid were added to the filtered cake and mixed by the TK-type homomixer at 12,000 rpm for 10 min, and the mixture was filtered.

Further, 300 parts of ion-exchange water were added to the filtered cake and mixed by the TK-type homomixer at 12,000 rpm for 10 min, and the mixture was filtered. This operation was repeated again to prepare a [filtered cake 1].

The [filtered cake 1] was dried by an air drier at 45° C. for 48 hrs and sieved by a mesh having an opening of 75 μm to prepare a [toner particle 1]. Then, 1 part of hydrophobized silica was mixed with 100 parts of the [toner particle 1] by a Henschel mixer to prepare a toner 1.

(Preparation of Carrier>

The following materials were dispersed by a stirrer for 10 min to prepare a coating liquid.

| | |
|---|---|
| Toluene | 450 |
| Silicone resin SR2400 having a nonvolatile matter of 50% from Dow Corning Toray Silicone Co., Ltd. | 450 |
| Amino silane SH6020 from Dow Corning Toray Silicone Co., Ltd. | 10 |
| Carbon black | 10 |

The coating liquid was coated on the following core material by a coater coating while forming a spiral flow with a rotational bottom board disc and a stirring blade in a fluidizing bed.

| | |
|---|---|
| Mn Ferrite particle having a weight-average particle diameter of 35 μm | 5,000 |

The coated material was calcined in an electric oven at 250° C. for 2 hrs to prepare the above-mentioned carrier.

<Preparation of Two-Component Developer>

When evaluating images with a two-component developer, 100 parts of a ferrite carrier having an average particle diameter of 35 μm, coated with a silicone resin layer having an average thickness of 0.5 μm, and 7 parts of each color toner were uniformly mixed in a Turbula mixer to form a two-component developer.

Examples 2 to 4

The procedure for preparation of the toner 1 was repeated to prepare a toner 2 (Example 2), a toner 3 (Example 3) and a toner 4 (Example 4) except for replacing the masterbatch 1 with the masterbatches 2 to 4.

Comparative Examples 1 and 2

The procedure for preparation of the toner 1 was repeated to prepare a toner 5 (Comparative Example 1) and a toner 6 (Comparative Example 2) except for replacing the masterbatch 1 with the masterbatches 5 and 6.

An average circularity, and a shape factor SF-1 and a shape factor SF-2 of each of the toners 1 to 6 are shown in Table 2.

TABLE 2

| | Average circularity | SF-1 | SF-2 | Dv | Dv/Dn |
|---|---|---|---|---|---|
| Toner 1 | 0.968 | 134 | 125 | 5.8 | 1.24 |
| Toner 2 | 0.966 | 136 | 129 | 5.7 | 1.22 |
| Toner 3 | 0.969 | 137 | 138 | 5.6 | 1.21 |
| Toner 4 | 0.931 | 143 | 128 | 5.7 | 1.18 |
| Toner 5 | 0.964 | 122 | 119 | 4.9 | 1.20 |
| Toner 6 | 0.968 | 136 | 123 | 4.8 | 1.25 |

The following items of each of the toners were evaluated, and the results are shown in Table 3.

1) Image Density

Imagio Neo 450 was modified to have a fixing belt, and a solid image was produced thereby on an ordinary transfer paper TYPE 6200 from Ricoh Company, Ltd. such that a toner adhered thereto in an amount of 0.3±0.1 mg/cm$^2$. The image density thereof was measured by X-Rite from X-Rite, Inc. ○ means that the image density is not less than 1.4, and X means the image density less than 1.4.

2) Fixability (Hot Offset Resistance and Low-Temperature Fixability)

Imagio Neo 450 was modified to have a fixing belt, and a solid image was produced on an ordinary transfer paper and a thick transfer paper (TYPE 6200 from Ricoh Company, Ltd. and Copy Paper <135> from NBS RICOH Co., Ltd.) such that a toner adhered thereto in an amount of 1.0±0.1 mg/cm$^2$. A temperature of the fixing belt was changed to perform a fixing test and a maximum temperature at which the hot offset does not occur on the ordinary transfer paper was determined as a maximum fixable temperature. A temperature at which the image density of an image produced on the thick paper had a residual ratio not less than 70% was determined as a minimum fixable temperature. It is desirable that the maximum fixable temperature is not less than 200° C., and the minimum fixable temperature is not greater than 140° C.

3) Cleanability

After 1,000 pieces of a chart having an image area of 95% were produced, a residual toner on a photoreceptor just before cleaned was adhered on a Scotch Tape from Sumitomo 3M Ltd. and transferred onto a blank paper. The density of the blank paper was measured by Macbeth reflection densitometer RD514. When a difference of density between a blank paper the residual toner was transferred onto and a original blank paper was less than 0.005, the cleanability was determined as ◎. From 0.005 to 0.010 was ○, from 0.011 to 0.02 was Δ and greater than 0.02 was X.

4) Transferability

After a chart having an image area of 20% was transferred onto a paper from a photoreceptor, a residual toner on the photoreceptor just before cleaned was adhered on a Scotch Tape from Sumitomo 3M Ltd. and transferred onto a blank paper. The density of the blank paper was measured by Macbeth reflection densitometer RD514. When a difference of density between the blank paper the residual toner was transferred to and an original blank paper was less than 0.005, the cleanability was determined as ◎. From 0.005 to 0.010 was ○, from 0.011 to 0.02 was Δ and greater than 0.02 was X.

5) Stability of being Charged

Before and after 100,000 copies of a chart having an image area of 5% were continuously produced by IPSio Color 8100 from Ricoh Company, Ltd. modified to have an oilless fixer, a charged amount of 1 g of the developer was measured by a blow-off method. A variation of the charge amount of not greater than 5 μc/g was ○, not greater than 10 μc/g was Δ and greater than 10 μc/g was X.

6) Image Granularity and Sharpness

A mono-color image produced by IPSio Color 8100 from Ricoh Company, Ltd. modified to have an oilless fixer was visually observed to evaluate the image granularity and sharpness. ◎ was as good as an offset printing, ○ was slightly worse than the offset printing, Δ was considerably worse than the offset printing and X was very poor.

7) Transparency

A mono-color image produced on an OHP sheet by IPSio Color 8100 from Ricoh Company, Ltd. modified to have an oilless fixer, such that a toner adhered thereto in an amount of 0.4 mg/cm$^2$. A projected image from the OHP was visually observed and classified to the following grades.

◎: completely transparent and good coloring

○: slightly cloudy

Δ: apparently cloudy

X: not projected

8) Foggy Image

After 100,000 copies of a chart having an image area of 5% were continuously produced by IPSio Color 8100 from Ricoh Company, Ltd. modified to have an oilless fixer at 10° C. and a humidity of 15%, the background of the last image was visually observed to evaluate the toner contamination thereon. ◎ means that no toner contamination was observed, ○ means a slight contamination without problems, Δ means a contamination was observed and X means an unacceptable contamination with serious problems.

9) Toner Scattering

After 100,000 copies of a chart having an image area of 5% were continuously produced by IPSio Color 8100 from Ricoh Company, Ltd. modified to have an oilless fixer at 40° C. and a humidity of 90%, the toner contamination in IPSio Color 8100 was visually observed. ◎ means that no toner contamination was observed, ○ means a slight contamination without problems, Δ means a contamination was observed and X means an unacceptable contamination with serious problems.

TABLE 3

| | Toner No. | 1) | 2) | 3) | 4) | 5) | 6) | 7) | 8) | 9) |
|---|---|---|---|---|---|---|---|---|---|---|
| Ex. 1 | 1 | ○ | 145° C. | ○ | ◎ | ◎ | ◎ | ○ | ○ | ◎ |
| Ex. 2 | 2 | ○ | 150° C. | ◎ | ◎ | ◎ | ◎ | ◎ | ◎ | ◎ |
| Ex. 3 | 3 | ○ | 145° C. | ○ | ◎ | ○ | ○ | ◎ | ◎ | ◎ |
| Ex. 4 | 4 | ○ | 145° C. | ◎ | ◎ | ◎ | ◎ | ◎ | ◎ | ◎ |
| Com. Ex. 1 | 5 | ○ | 150° C. | ○ | ○ | Δ | Δ | Δ | Δ | Δ |
| Com. Ex. 2 | 6 | X | 165° C. | Δ | Δ | X | X | Δ | X | X |

This application claims priority and contains subject matter related to Japanese Patent Applications Nos. 2005-016366 and 2005-073359, filed on Jan. 25, 2005 and Mar. 15, 2005 respectively, the entire contents of each of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, comprising:

a parent particulate material, comprising;

a first colorant, a second colorant, and a binder resin, wherein the first colorant comprises an organic pigment having a primary particle diameter distribution with a median diameter of from 0.08 to 0.12 μm, and the second colorant comprises an organic pigment having a primary particle diameter distribution with a median diameter of from 0.01 to 0.06 μm, and each of said first colorant and second colorant having the following formula (1)

(1)

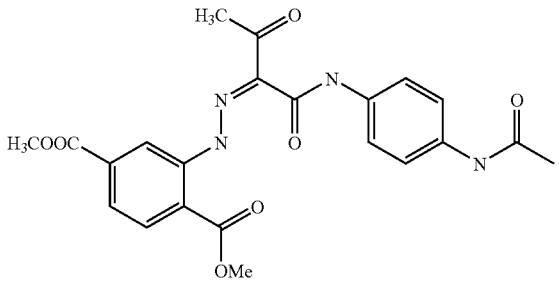

-continued

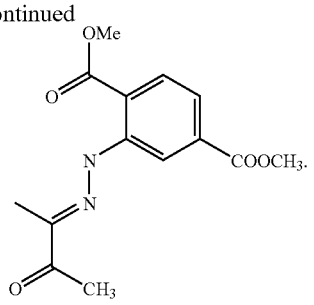

2. The toner of claim 1, wherein the binder resin comprises a polyester resin.

3. The toner of claim 1, wherein the binder resin comprises a modified polyester resin.

4. The toner of claim 2, wherein the polyester resin is a mixture of a modified polyester resin and a non-modified polyester resin.

5. The toner of claim 1, wherein the toner has an average circularity of from 0.90 to 0.99.

6. The toner of claim 1, wherein the toner has a shape factor SF-1 of from 100 to 150 and a shape factor SF-2 of from 100 to 140.

7. The toner of claim 1, wherein the toner has a volume-average particle diameter (Dv) of from 2 to 7 μm and a ratio (Dv/Dn) of the volume-average particle diameter (Dv) to a number-average particle diameter (Dn) thereof not greater than 1.25.

8. The toner of claim 1, wherein a mixing ratio of the first colorant to the second colorant is from 10/90 to 50/50 by weight.

9. The toner of claim 1, wherein the toner is prepared by a method comprising:

dissolving a toner composition including a prepolymer in a solvent to prepare an oil drop; and dispersing the oil drop in an aqueous medium to be subjected to at least one of an elongation reaction and a crosslinking reaction.

10. The toner of claim 9, wherein the toner composition including a prepolymer comprises a masterbatch comprising the binder resin and the first and second colorants.

11. A two-component developer, comprising:

the toner according to claim 1; and a carrier comprising a magnetic particulate material.

12. The two-component developer of claim 11, wherein the toner has an average circularity of from 0.90 to 0.99.

13. The two-component developer of claim 11, wherein the toner has a shape factor SF-1 of from 100 to 150 and a shape factor SF-2 of from 100 to 140.

14. The two-component developer of claim 11, wherein the toner has a volume-average particle diameter (Dv) of from 2 to 7 μm and a ratio (Dv/Dn) of the volume-average particle diameter (Dv) to a number-average particle diameter (Dn) thereof not greater than 1.25.

15. The two-component developer of claim 11, wherein a mixing ratio of the first colorant to the second colorant is from 10/90 to 50/50 by weight.

16. A process cartridge detachable from an image forming apparatus, comprising:

an image developer configured to develop an electrostatic latent image with the toner according to claim 1; and at least one of an electrophotographic photoreceptor, a charger and a cleaner.

17. An image forming apparatus, comprising:

an image bearer;

a charger configured to charge the image bearer to form an electrostatic latent image thereon;

an image developer configured to develop the electrostatic latent image with a developer including a toner to form a toner image thereon;

a transferer configured to transfer the toner image onto a transfer sheet; and a fixer configured to fix the toner image on the transfer sheet, wherein the developer is the two-component developer according to claim 11.

18. The image forming apparatus of claim 17, wherein a mixing ratio of the first colorant to the second colorant in the toner of the developer is from 10/90 to 50/50 by weight.

19. An image forming method, comprising:

charging an image bearer to form an electrostatic latent image thereon;

developing the electrostatic latent image with a developer including a toner to form a toner image thereon;

transferring the toner image onto a transfer sheet; and fixing the toner image on the transfer sheet, wherein the developer is the two-component developer according to claim 11.

20. The image forming method of claim 19, wherein a mixing ratio of the first colorant to the second colorant in the toner of the developer is from 10/90 to 50/50 by weight.

* * * * *